US007412069B2

(12) United States Patent
Workman et al.

(10) Patent No.: US 7,412,069 B2
(45) Date of Patent: Aug. 12, 2008

(54) STABLE ATTACHMENT MICROPHONE STAND SYSTEMS

(75) Inventors: Jonathan P. Workman, Loveland, CO (US); Todd Eimen, Fort Collins, CO (US)

(73) Assignee: Swift Distribution, Inc., Torrence, CA (US)

( * ) Notice: Subject to any disclaimer, the term of this patent is extended or adjusted under 35 U.S.C. 154(b) by 384 days.

(21) Appl. No.: 10/894,700

(22) Filed: Jul. 19, 2004

(65) Prior Publication Data

US 2006/0013427 A1 Jan. 19, 2006

(51) Int. Cl.
*H04R 25/00* (2006.01)

(52) U.S. Cl. ..... 381/363; 381/366; 381/390

(58) Field of Classification Search ..... 381/361–368, 381/386–390, 395; 248/158–159
See application file for complete search history.

(56) References Cited

U.S. PATENT DOCUMENTS

| | | | | |
|---|---|---|---|---|
| 3,573,401 | A | 4/1971 | Lininger | 179/147 |
| 4,634,307 | A * | 1/1987 | Gnaedinger et al. | 403/194 |
| 4,718,624 | A | 1/1988 | Greulich | 248/158 |
| 4,943,182 | A | 7/1990 | Hoblingre | 403/349 |
| 5,046,693 | A | 9/1991 | Browne | 248/159 |
| 5,497,965 | A | 3/1996 | Mathieu, Jr. | 248/159 |
| 5,893,541 | A | 4/1999 | Michaelson | 248/158 |
| 6,588,717 | B2 | 7/2003 | Carnahan et al. | 248/188.8 |
| 6,612,534 | B2 | 9/2003 | Hennessey | |
| 6,666,427 | B2 * | 12/2003 | Hennessey | 248/523 |

OTHER PUBLICATIONS

Ultimate Support Systems, Inc. 1992 Bicycle Repair Station Product Brochure (2 pages).
Ultimate Support Systems, Inc. 1993 Bicycle Support Product Catalog and Price List.
Ultimate Support Systems, Inc. 1993 Product Catalog (Music Stand Edition).
Ultimate Support Systems, Inc. 1994 Product Catalog (Music Stand Edition).
Ultimate Support Systems, Inc. 1995 Bicycle Support Domestic Confidential Dealer Price List.
Ultimate Support Systems, Inc. 1996 Product Catalog (Music Stand Edition).
Ultimate Support Systems, Inc. 1998 Product Catalog (Music Stand Edition).
Ultimate Support Systems, Inc. 1999 Product Catalog (Music Stand Edition).
Ultimate Support Systems, Inc. 2000 Product Catalog (Music Stand Edition).
Ultimate Support Systems, Inc. 2000 Bicycle Support Product Catalog.

(Continued)

*Primary Examiner*—Suhan Ni
(74) *Attorney, Agent, or Firm*—Santangelo Law Offices, P.C.

(57) ABSTRACT

Microphone stand attachment systems to attach a support base to a longitudinal axial element easily, quickly and securely. An attachment guide may include a threaded plug and a support base may include a threaded socket. In embodiments, a male tapered flange may frictionally lock with a female tapered element of a socket to secure a longitudinal axial element to a support base. Specific attachment structures, in embodiments, are also described, as are various plugs, tapers, sockets and methods of attaching a support base to a longitudinal axial element.

27 Claims, 5 Drawing Sheets

OTHER PUBLICATIONS

Ultimate Support Systems, Inc. 2001 Product Catalog (Music Stand Edition).
Ultimate Support Systems, Inc. 2001/2002 Bicycle Support Product Catalog.
Ultimate Support Systems, Inc. 2002 Product Catalog (Music Stand Edition).
Ultimate Support Systems, Inc. 2003 Product Catalog (Music Stand Edition).
Ultimate Support Systems, Inc. 2002/2003 Bicycle Support Product Catalog.
Ultimate Support Systems, Inc. 2004 Product Catalog (Bicycle Stand Edition).
Ultimate Support Systems, Inc. 2004 Product Catalog (Music Stand Edition).
Ultimate Support Systems, Inc. 2005 Product Catalog (Bicycle Stand Edition).
Ultimate Support Systems, Inc. 2005 Product Catalog (Music Stand Edition).

* cited by examiner

STABLE ATTACHMENT MICROPHONE STAND SYSTEMS

BACKGROUND

This invention relates to microphone stand systems that may facilitate microphone stand assembly and disassembly and may even stabilize an assembled microphone stand. The invention may provide, in general, a microphone stand assembly that has a longitudinal axial element securely attached, yet removable from a support base.

Under some circumstances, it may be desirable for a microphone stand to be easily disassembled and assembled to facilitate transportation. Traditional microphone stands may have been unsuccessful possibly due to a failure to provide a sufficiently stable and quick attaching microphone stand. Microphone stand assemblies may include a threaded microphone pole attached to a weighted base which may be attached by threading the pole into the base. The assembly and disassembly of a microphone pole to its base may be time consuming and potentially destructive, possibly due to cross-threading. When attached, a pole may not be stably situated into the base. For example, a pole-base attachment may allow for movement of the pole inside of a base. This movement may loosen the attachment and may even allow a pole to undesirably detach from a base during use.

Traditionally, some microphone stands may have included many threads with a very fine pitch which may be have been useful to make a pole to base combination secure with no wobble or play between the pole and base. Yet, this may have resulted in a time consuming and frustrating disassembly and assembly. A threaded connection may be very rugged so that a base, while typically being heavy, can remain attached to a pole during a performance where it may often be picked up.

Threading features of microphone stand systems may have been difficult to properly align the parts, such as from a standing position with a base resting on the floor, and many revolutions of a pole or shaft may be have been required for full tightening.

U.S. Pat. No. 4,718,624 to Greulich may show a stand tube pivotally supported in a cast base. A locking means, such as a locking pin, rotating locking cone or coupler may attach a tube to a base possibly for securement.

U.S. Pat. No. 5,046,693 to Browne may include a microphone stand coupler that may be inserted through an opening of a base and secured to a base by way of an over-center cam lever attached to a coupler. A microphone pole may have a hole to accommodate a lever actuated cam mechanism. A cam lever may interact with a base to secure a pole to a base and may even allow actuation of a lever to quickly disconnect a pole from a base.

U.S. Pat. No. 4,943,182 to Hoblingre discloses another quick disconnect mechanism which may include an axial spring loaded bayonet. A pole may be held to a base by spring load and by twisting a pole relative to a base against the spring load, a pole may be positioned for removal.

In U.S. Pat. No. 6,666,427 to Hennessey, a microphone stand assembly may utilize a low profile base and even a screw-in shaft of adjustable height. A coarse thread may be used for durability and an anti-rotation arrangement may provide stability and convenience of use.

SUMMARY OF THE INVENTION

The present invention includes a variety of aspects which may be selected in different combinations based upon the particular application or needs to be addressed. In one basic form, the invention discloses attaching a longitudinal axial element to a support base to assemble a microphone stand and can include various types of attachments. A longitudinal axial element may have a plug, such as a threaded plug at an end which may be attachable to a socket, such as a threaded pocket of a support base.

It is a general object of this invention to provide a microphone stand that may have a longitudinal axial element stably attached to a microphone support base.

It is an object of the present invention to provide a microphone stand system in which a longitudinal axial element can be frictionally locked with a support base.

It is an object of the invention to provide a longitudinal axial element that may be threadingly attached into a socket of a microphone support base.

It is another object of the present invention to provide smooth mating of a longitudinal axial element into a support base.

It is yet another object of the invention to provide a quick assembly and disassembly of a microphone stand.

Still yet further objects of the invention will be apparent from this specification, including the drawings.

DETAILED DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however, it should be understood that they may be combined in any manner and in any number to create additional embodiments. The variously described examples and preferred embodiments should not be construed to limit the present invention to only the explicitly described systems, techniques, and applications. This description should further be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 4:
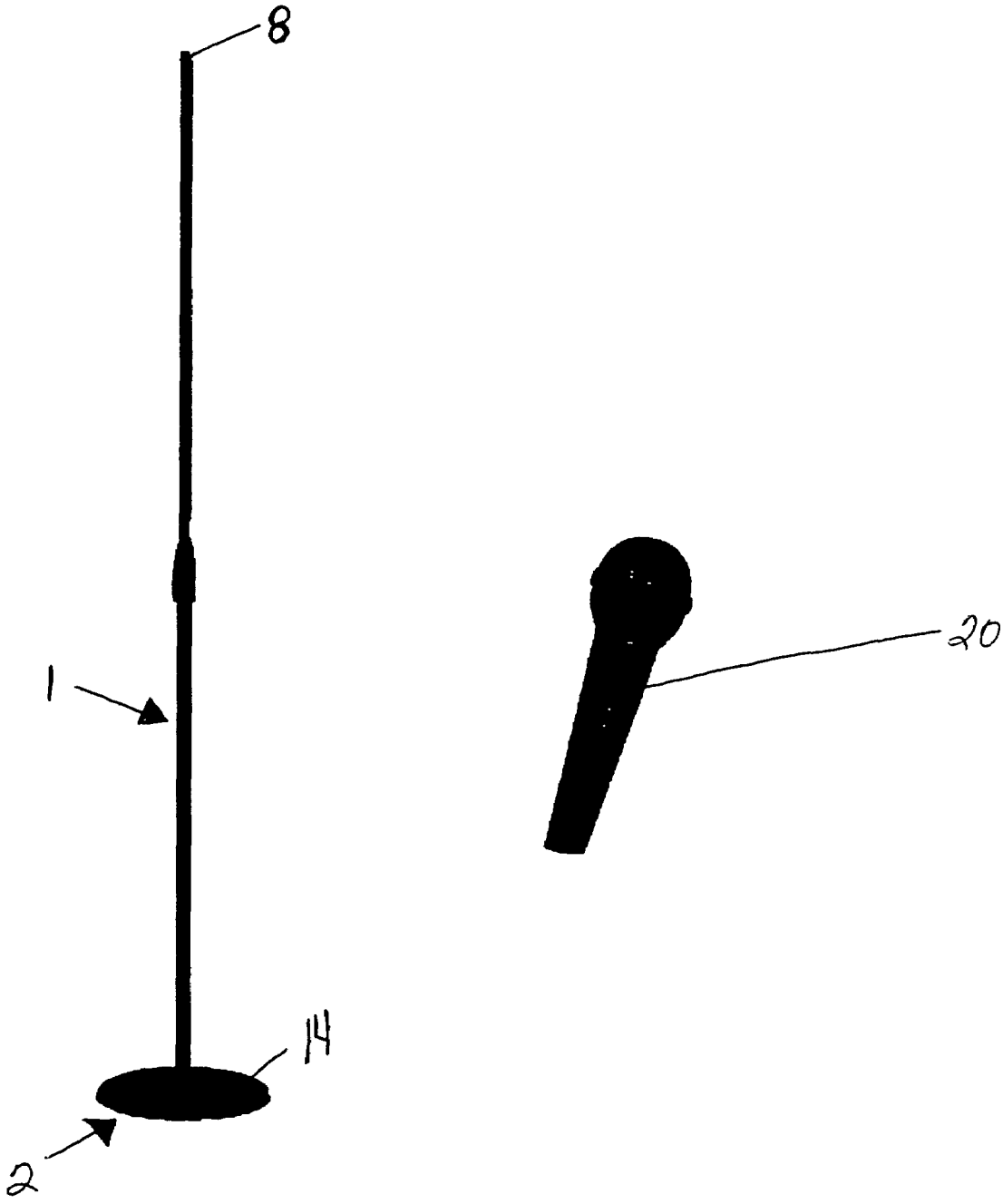
FIG. 4 is a general embodiment of the present invention representing a microphone stand with a microphone, longitudinal axial element and a support base.

Generally, a microphone stand assembly may include a support base (2), a longitudinal axial element (1) and a microphone attachment (8) which may attach a microphone (20) to the stand as can be seen in FIG. 4. A microphone attachment may include any of kind of attachment and may be located at an end, such as opposite to a support base attachment, of a longitudinal axial element.

A longitudinal axial element may be a microphone shaft, a microphone pole, may be tubing, may be straight, may be a solid element, may be circular, rectangular or the like shapes, and may even be flexible, bent or curved. In embodiments, a longitudinal axial element may be made of plastic, metal, steel or the like components. A longitudinal axial element may include any type of material such as but not limited to plastic, metal, aluminum, steel, iron, cast iron, non-metallic materials, ceramic, glass, resins, carbon fiber, polymers, ferrous metals, nonferrous metals, pure metallic elements, composites, ceramic, boride, carbide, halide, nitrides, oxides, glass, glass ceramic, wood, solid materials and the like. In embodiments, it may be desirable to adjust a longitudinal axial element to a desired height. This may be accomplished by telescopically adjusting a longitudinal axial element. A telescopic longitudinal axial element may be provided where the length of the axial element may become shorter by sliding a smaller portion of a longitudinal axial element into a larger portion. There may be a height adjustment securement that can be tightened or engaged so as to hold the longitudinal axial element in its desired position.

A support base may be any type of structure that may allow a longitudinal axial element to be placed upright and which may support a longitudinal axial element. A support base may be removably attached to a longitudinal axial element in that a support base may be attached and detached to a longitudinal axial element. For example, a support base may be a round base (14), a U-shaped base (15) or any other kind of shape. A support base may be made of any kind of material, such as but not limited to, plastic, metal, aluminum, steel, iron, cast iron, non-metallic materials, ceramic, glass, resins, carbon fiber, polymers, ferrous metals, nonferrous metals, pure metallic elements, composites, ceramic, boride, carbide, halide, nitrides, oxides, glass, glass ceramic, wood, solid materials and the like. In embodiments, a support base may be made by sand casting and the like. It may be desirable to use a material that provides a weighted support base. Alternatively, a lightly weighted support base may be used.

Figure 2:
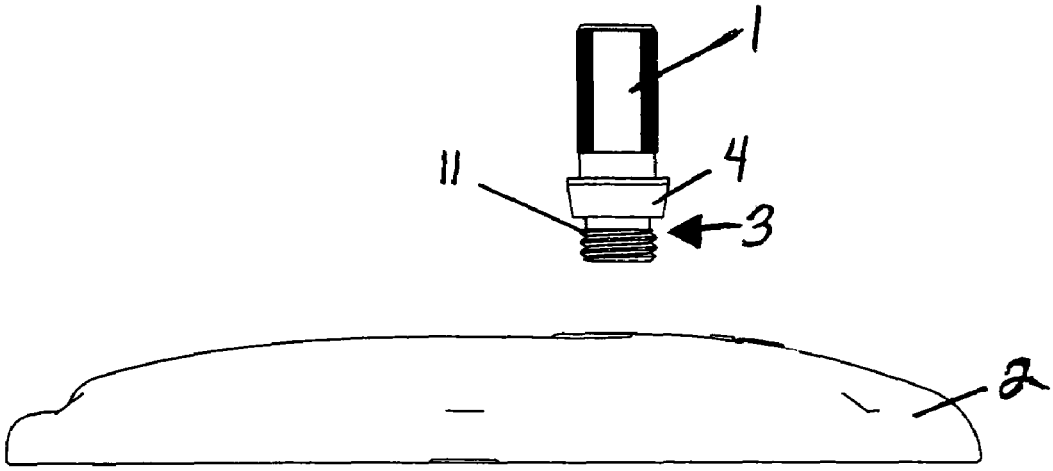
FIG. 2 is a side view of an embodiment of the present invention for an attachment guide and support base.
Figure 3:
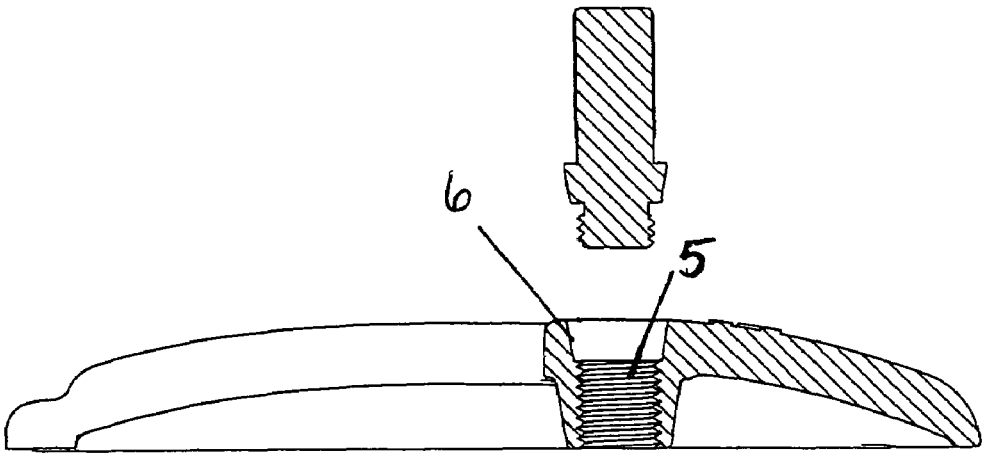
FIG. 3 is a sectional view showing section A-A of FIG. 1 of a socket of a support base and an attachment guide according to embodiments of the present invention.

In order to detach and attach a microphone stand assembly system, an attachment guide may be used in attaching an end of a longitudinal axial element to a support base. Accordingly, an attachment guide (3) may be located or even placed at an end of a longitudinal axial element. Generally, an attachment guide may be a device or method that can regulate or even direct progressive motion or action. For example, an attachment guide may be a plug, which may fit into, be inserted into or perhaps even fill a socket in a support base. A plug may facilitate the connection between a longitudinal axial element and a support base. In other embodiments, an attachment guide may be threaded plug and may even provide a longitudinal axial element to be threadingly attached to a support base. A threaded plug may have threads spirally located around a pin, rod, cylindrical rod or the like. A threaded plug may include one or more helical or advancing spiral threads. Each thread may be a helical ridge of a plug. In yet other embodiments, an attachment guide may be a coarsely threaded plug which may include a plug having coarse threads. An externally threaded plug, as shown in FIGS. 2 and 3, may be used in embodiments of the present invention.

The present invention, in some embodiments, may provide for a removable threaded plug attachment. It may be desirable to removably attach a threaded plug to an end of a longitudinal axial element with perhaps a threaded plug attachment. This may be needed if a threaded plug gets worn and one would like to replace the threaded plug without having to replace the entire longitudinal axial element. It may also be desirable to provide a universal threaded plug attachment which may universally attach a threaded plug to an end of various kinds of longitudinal axial elements.

In embodiments, the present invention may provide for a flange that can be located near an attachment guide, such as a plug attached to a longitudinal axial element. A flange may be an element that may be used in the connection of a longitudinal axial element and a support base. For example, a flange may be a projecting rim as shown in FIG. 4. In embodiments, a flange may be tapered flange. By a tapered flange, it is understood that a flange may become gradually narrower in one direction. This may include a descending flange or an ascending flange. In embodiments, a flange may even be a male tapered flange so that it may mate with and even locking mate with a female tapered element that may be located in a socket of a support base. Male and female tapered elements may simply be elements or pieces that may be able to fit into another piece. These of course, may be interchangeable. Specifically, a flange or even a tapered flange and may even create a friction lock between a flange and at least part of a socket when attached. A tapered flange may provide the stability needed for an assembled microphone stand. Angled surfaces of male and female tapers may meet and provide a mechanically advantaged locking force against removal and may even provide a stability element between a male tapered flange and a female tapered flange. In embodiments, a taper may be conical or perhaps may even be a non-conical surface.

A socket in a support base may be a hollow element to which a corresponding part may fit. A socket may be a tapped collar or socket that can receive a plug element. In some embodiments, a threaded socket may be used with a threaded plug. A threaded plug may engage with a threaded socket and can fasten them together. In embodiments the present invention may provide engaging a plug with a socket and may even provide engaging at least one coarse thread of a plug with a threaded socket of a support base. Threads of a plug may interlock with a threaded socket.

In other embodiments, a socket may have a tapered element, such as a female tapered element. A male tapered element may fit into a female tapered element. In some embodiments, a socket may be a threaded socket with a female tapered element wherein a threaded plug may engage with the threaded socket and a male tapered element of a longitudinal axial element may lock with the female tapered element.

Figure 1:
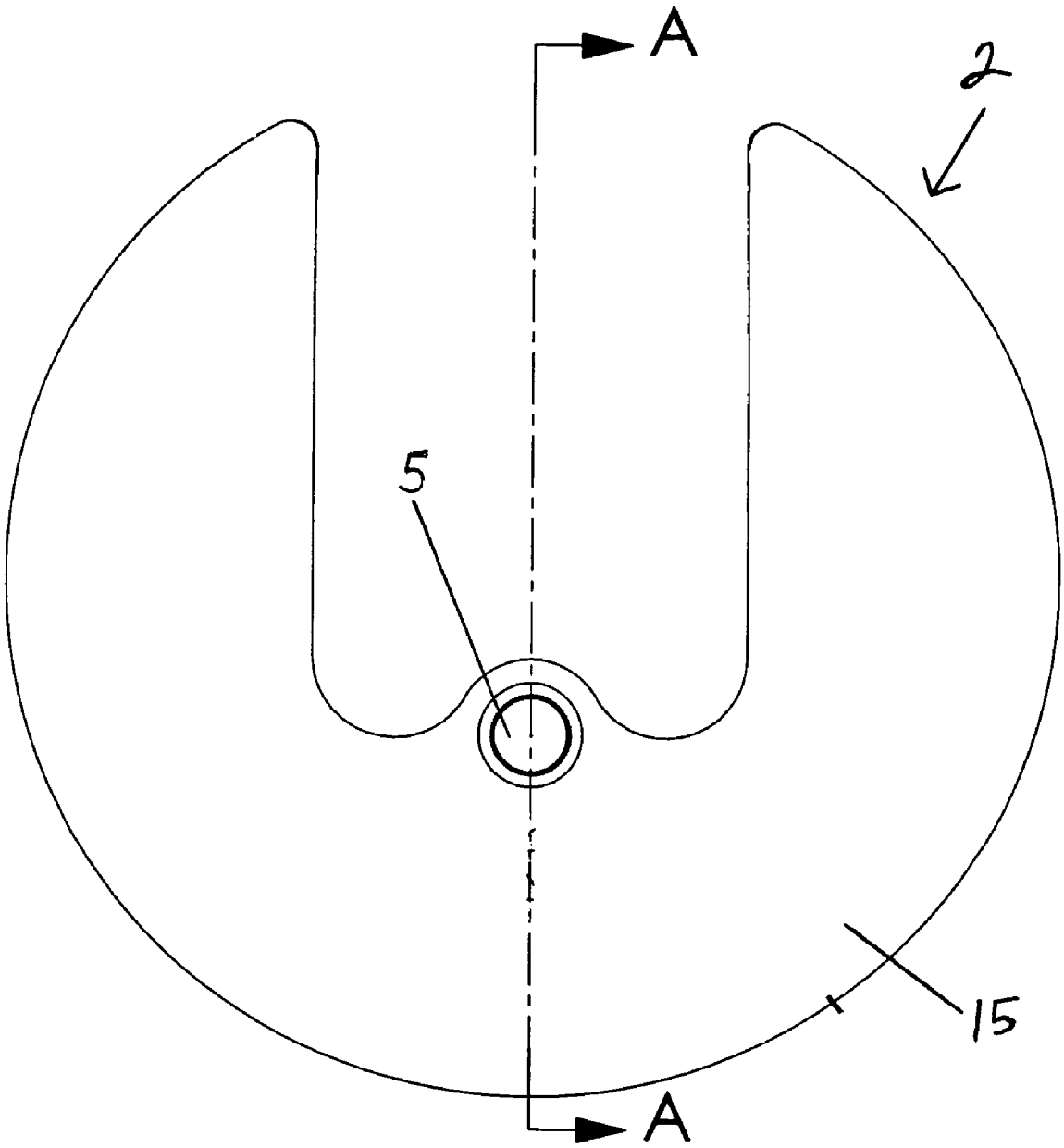
FIG. 1 is a top view of an embodiment of a support base of the present invention.

As shown in FIGS. 1, 2 and 3, a support base (2) having a threaded socket (5) may be attached to a longitudinal axial element (1) with an attachment guide (3). As stated above, in some embodiments, a support base may be a U-shaped base (15) as seen in FIG. 1. Of course, a support base may be any kind of shape and all shapes are meant to be included in this disclosure. In embodiments, a flange (4) may be located above an attachment guide (3), as seen in FIG. 2. Threads (11) of a threaded plug may be used in an attachment guide to attach to a threaded socket (5) of a support base. In other embodiments and as can be understood from FIG. 7, a male tapered flange may be located below a plug and the like.

In embodiments, the present invention may provide a number of thread starts on a plug. For example, there may be two thread starts, three thread starts, four thread starts, and the like. Of course, other numbers of thread starts are possible and all are meant to be included in this disclosure. In embodiments, threads may be fine threads and, alternatively, may be coarse threads.

A tapered flange may have a taper angle. An optimal angle may vary depending on the materials of the mating components, the finish applied to them and possibly even the amount of torque that can be applied. A taper angle (21) may be measured as shown angle in FIG. 9. An angle may be larger than zero and in embodiments, smaller than 45 degrees. A desired effect may be to lock mating parts together using less torque than it may take to separate the parts. A desired effect may also be to cause the locking and unlocking of the mating parts to occur over a larger degree of rotation than a flat flange or no flange. This may be a result of the mechanically advantaged radial deflection of the tapered elements. In embodiments, a taper angle may be between about 5 degrees and about 20 degrees. A taper angle may include, but is certainly not limited to the following:

less than about 45 degrees;
less than about 30 degrees;
less than about 20 degrees;
less than about 15 degrees;
less than about 10 degrees; and
less than about 5 degrees.

Of course, an angle of a taper may vary while still achieving a locking result.

Figure 5:
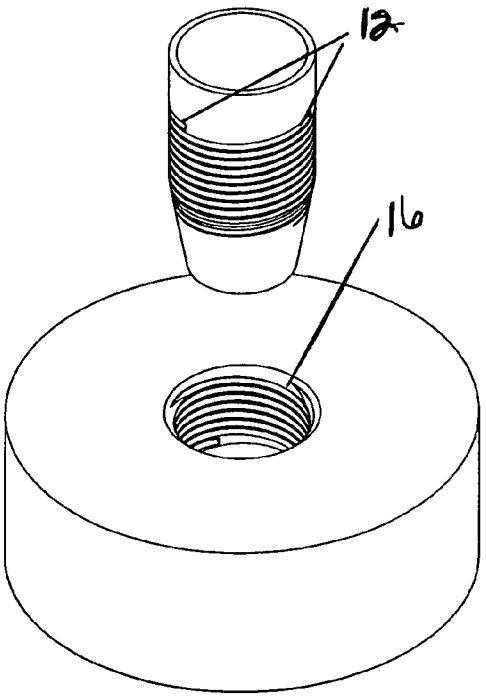
FIG. 5 is a partial view representing a threaded plug and a threaded socket according to embodiments of the present invention.
Figure 6:
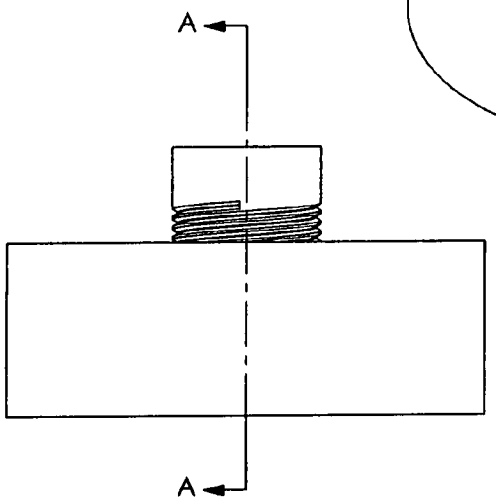
FIG. 6 is a side partial view representing a threaded plug partially engaged with a threaded socket according to embodiments of the present invention.

In embodiments, multiple lead threads (12), also known as multiple start threads, as shown in FIG. 5 may be engaged with a lead (16), more than one lead, a double lead, or even multiple leads in a socket. A lead may be the distance that a thread may travel in one revolution. Accordingly, the present invention may provide for engaging a multiple lead (multiple start) threaded plug into a socket. The use of multiple threads may help to easily guide a longitudinal axial element into a socket and perhaps may even allow quicker attachment of the two pieces. Of course, multiple coarse threads may be used. As such, and in some embodiments, the present invention may provide easily guiding at least one coarse thread of a threaded plug with a threaded socket of a support base. By easily guided, it may be understood that making a connection of a plug to a socket may be easily done. Past devices may have been harder to catch threads possibly because of the finer pitch used with only one start. Once threads have initially met, such as with an easy catch of a threaded plug to a threaded socket, a user may turn or rotate either a support base or a longitudinal axial element so as to engage at least one thread of a threaded plug with a threaded socket of a support base. As seen in FIG. 6, a threaded plug may be engaged with a threaded socket by rotation. A rotation may be the turning of a plug or even a threaded socket about 360 degrees. In embodiments, a total rotation amount which may be the number of rotations that it may take to completely engage or detach a threaded plug from a threaded socket. A total rotation amount can include any number of rotations and all are meant to be included in this disclosure. For example, a total rotation amount may be less than four rotations, less than three rotations, less than two rotations, even less than one rotation and the like, and may provide quick attachment of, or even a quick attachment element to connect an end of a longitudinal axial element to a support base. Coarse threads, a large lead and the like may individually or even collectively help to quickly attach a longitudinal axial element to a support base.

Figure 7:
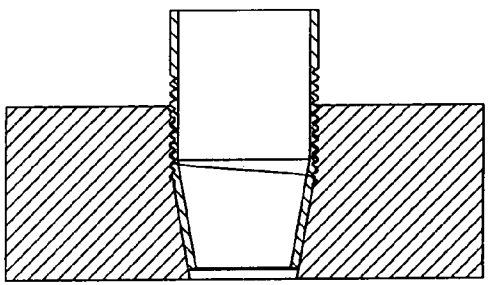
FIG. 7 is a sectional view showing a cross section A-A of FIG. 6.

It may take as little as less than one turn, one turn, two rotations, three rotations or even more rotations until a tapered flange may frictionally connect with an associated tapered flange of a socket. At a point when a plug has been fully placed into a socket and a tapered flange has been frictionally locked to a tapered element, such as a female tapered element of a support base, a longitudinal axial element and support base may be stably secured. FIG. 7 shows the engagement of a threaded plug with a threaded socket.

Figures 8, 9, 10:
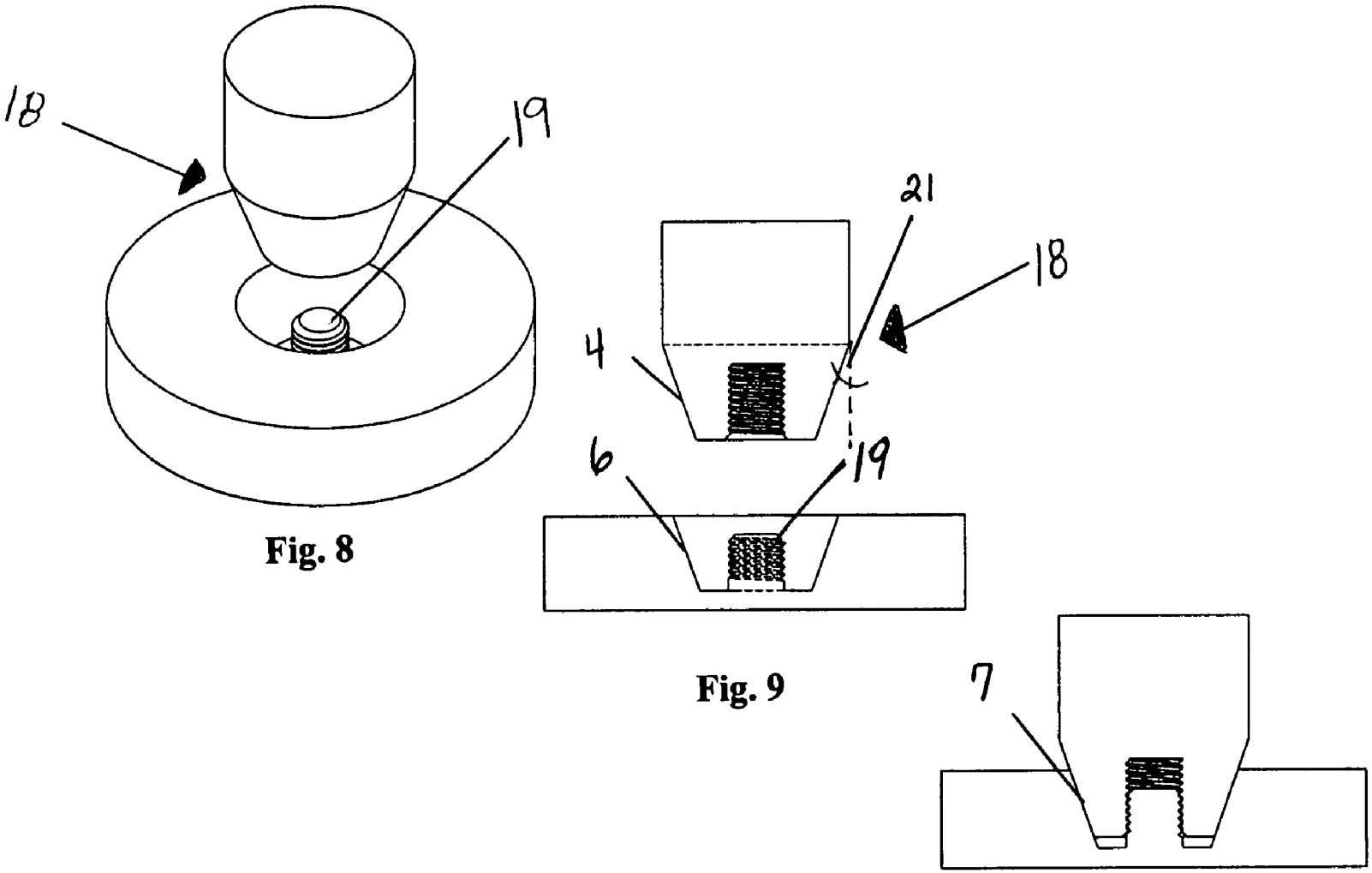
FIG. 8 is an alternative embodiment of a plug and a socket of the present invention.
FIG. 9 is a partial view an internally threaded plug and a male threaded element of a socket according to various embodiments of the present invention.
FIG. 10 is a partial view of a friction lock of an internally threaded plug and a male threaded element of a socket according to various embodiments of the present invention.

In alternative embodiments, an attachment guide may be an internally threaded plug (18) as shown in FIGS. 8, 9 and 10. A male tapered part may be tapped with internal threads and a female taper may be fitted with a stationary threaded stud or other such device, the effect may be the same. One part may thread the parts together until they engage and lock up. Accordingly, a socket may have a male threaded element (19) to engage with an internally threaded plug (18). An internally threaded plug may have a recessed or threaded socket within the plug and the internally threaded plug may be attached to a male threaded element by rotation of either or both the longitudinal axial element or a support element. A male threaded element may be a protruding structure that may be threaded. A flange (4) or even a tapered flange may be configured to mate with a female tapered element (6) of a socket. As can be understood in FIG. 10, when a flange and a female tapered element mate, they may create a friction lock (7). This friction lock may occur with any type of plug element such as an externally threaded plug, an internally threaded plug, a non-threaded plug and the like plugs.

Different types of threads may be used and all are meant to be included in this disclosure. For example, nationally accepted standards may be used such as those referenced in ANSI/ASME B1.7M—1984 (R1992) and ANSI/ASME B1.13M—1983 (R1989), each hereby incorporated by reference. For example, a thread may be a ¾-10 UNC-2A thread. Other styles of threads may include ACME, Buttress, Löwenherz, Whitworth, rolled threads, special threads or any other thread. An attachment guide or attachment systems may be any system that may be capable of bringing together two mating parts such as but not limited to cams, levers, eccentric pins, and the like. It is to be understood that any number of pitches may be used with the various embodiments of the present invention and all are meant to be included with this disclosure.

In embodiments, a multiple-lead thread may be used, such as if a thread has more than one start. In other embodiments, a coarse thread with a deep profile and a high helix angle may be used. It may be desirable to thread an outer diameter of a tube or plug, such as an externally threaded plug and engage this with a mating part, such as a threaded socket as shown in FIGS. 5 and 6. This may provide the attachment of an externally threaded plug to a threaded socket. Of course, fine threads may be used in other embodiments. A coarser thread may tend to resist stripping better than a fine-pitched one.

Of course in other embodiments, devices and methods herein may be applied to other kinds of stands such as but not limited to music stands, lighting stands, and the like.

As can be easily understood from the foregoing, the basic concepts of the present invention may be embodied in a variety of ways. It involves both attachment techniques as well as devices to accomplish the appropriate attachment. In this application, the attachment techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims herein included or that may be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "thread" should be understood to encompass disclosure of the act of "threading"—whether explicitly discussed or not—and, conversely, were there effective disclosure of the act of "threading", such a disclosure should be understood to encompass disclosure of a "thread" and even a "means for threading" Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed herein or in other information statements filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the attachment devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A method of assembling a microphone stand comprising the steps of:

attaching an end of a longitudinal axial element to a support base, wherein said end of said longitudinal axial element comprises a plug and a male tapered flange, and wherein said support base comprises a socket and a female tapered element; engaging said plug at said end of said longitudinal axial element with said socket of said support base;

frictionally lockingly mating said male tapered flange of said end of said longitudinal element with said female tapered element of said support base, wherein said male tapered flange and said female tapered element comprise corresponding angled tapers which fit into each other when mated; and stably securing said longitudinal axial element to said support base.

2. A method of assembling a microphone stand according to claim 1 wherein said step of attaching said end of said longitudinal axial element to said support base comprises the step of threadingly attaching said end of said longitudinal axial element to said support base.

3. A method of assembling a microphone stand according to claim 2 wherein said step of threadingly attaching said end of said longitudinal axial element to said support base comprises the step of threadingly attaching multiple threads of said plug into said socket of said support base.

4. A method of assembling a microphone stand according to claim 1 and further comprising the step of easily guiding said plug of said longitudinal axial element into said socket of said support base.

5. A method of assembling a microphone stand according to claim 4 wherein said step of easily guiding said plug of said longitudinal axial element into said socket of said support base comprises the step of engaging a multiple lead threaded plug into said socket.

6. A method of assembling a microphone stand according to claim 4 wherein said step of easily guiding said plug of said longitudinal axial element into said socket of said support base comprises the step of easily guiding a coarse thread of said plug into said socket of said support base.

7. A method of assembling a microphone stand according to claim 1 wherein said plug comprises a threaded plus, wherein said socket comprises a threaded socket, and further comprising the step of engaging at least one thread of said threaded plug with said threaded socket of said support base.

8. A method of assembling a microphone stand according to claim 7 wherein said step of engaging at least one thread of said threaded plug with said threaded socket of said support base comprises the step of easily catching said least one thread of said threaded plug to said threaded socket of said support base.

9. A method of assembling a microphone stand according to claim 7 wherein said step of engaging at least one thread of said threaded plug with said threaded socket of said support base comprises the step of engaging at least one course thread of said threaded plug with said threaded socket of said support base.

10. A method of assembling a microphone stand according to claim 7 and further comprising the step of removably attaching said threaded plug to said longitudinal axial element.

11. A method of assembling a microphone stand according to claim 7 and further comprising the step of universally attaching said threaded plug to said longitudinal axial element.

12. A method of assembling a microphone stand according to claim 7 and further comprising the step of locating said male tapered flange above said threaded plug of said longitudinal axial element.

13. A method of assembling a microphone stand according to claim 7 wherein said step of engaging said at least one thread of said threaded plug with said threaded socket of said support base comprises the step of engaging at least one coarse thread of said threaded plug with said threaded socket of said support base.

14. A method of assembling a microphone stand according to claim 7 and further comprising the step of providing a number of thread starts of said threaded plug selected from a group consisting of:

two thread starts;

three thread starts; and four thread starts.

15. A method of assembling a microphone stand according to claim 1 wherein said plug comprises an internally threaded plug, wherein said socket comprises a male threaded element, and further comprising the step of attaching said internally threaded plug to said male threaded element.

16. A method of assembling a microphone stand according to claim 1 wherein said wherein said plug comprises an externally threaded plug, wherein said socket comprises a threaded socket, and further comprising the step of attaching said externally threaded plug to said threaded socket.

17. A method of assembling a microphone stand according to claim 1 and further comprising the step of attaching a microphone to an opposite end of said longitudinal axial element.

18. A method of assembling a microphone stand according to claim 1 and further comprising the step of adjusting said longitudinal axial element to a desired height.

19. A method of assembling a microphone stand according to claim 18 wherein said step of adjusting said longitudinal axial element to said desired height comprises the step of telescopically adjusting said longitudinal axial element to said desired height.

20. A method of assembling a microphone stand according to claim 1 and further comprising the step of providing a material of said longitudinal axial element selected from a group consisting of plastic, metal, aluminum, steel, iron, cast iron, non-metallic materials, ceramic, glass, resins, carbon fiber, polymers, ferrous metals, nonferrous metals, pure metallic elements, composites, ceramic, boride, carbide, halide, nitrides, oxides, glass, glass ceramic and wood.

21. A method of assembling a microphone stand according to claim 1 and further comprising the step of providing a taper angle of said male tapered flange between about 5 degrees and about 20 degrees.

22. A method of assembling a microphone stand according to claim 1 and further comprising the step of providing a taper angle of said male tapered flange selected from a group consisting of:

less than about 45 degrees;

less than about 30 degrees;

less than about 20 degrees;

less than about 15 degrees;

less than about 10 degrees; and less than about 5 degrees.

23. A method of assembling a microphone stand according to claim 1 wherein said step of attaching said end of said longitudinal axial element to said support base comprises the step of quickly attaching said end of said longitudinal axial element to said support base.

24. A method of assembling a microphone stand according to claim 23 wherein said step of quickly attaching said end of said longitudinal axial element to said support base comprises the step of rotating said plug into said socket for a total rotation amount selected from a group consisting of:

less than four rotations;

less than three rotations;

less than two rotations, and less than one rotation.

25. A method of assembling a microphone stand according to claim 1 wherein said support base comprises a round base.

26. A method of assembling a microphone stand according to claim 1 wherein said support base comprises a u-shaped base.

27. A method of assembling a microphone stand according to claim 1 and further comprising the step of providing said support base made of a material selected from a group consisting of plastic, metal, aluminum, steel, iron, cast iron, non-metallic materials, ceramic, glass, resins, carbon fiber, polymers, ferrous metals, nonferrous metals, pure metallic elements, composites, ceramic, boride, carbide, halide, nitrides, oxides, glass, glass ceramic and wood.

* * * * *